US005108083A

United States Patent [19]

Russel et al.

[11] Patent Number: 5,108,083

[45] Date of Patent: Apr. 28, 1992

[54] RECIRCULATING DOCUMENT FEEDER HAVING A SELF-ADJUSTING BASE PLATE

[75] Inventors: Matthew J. Russel, Mendon; John E. Cockayne, Brockport, both of N.Y.

[73] Assignee: Eastman Kodak Company, Rochester, N.Y.

[21] Appl. No.: 617,230

[22] Filed: Nov. 23, 1990

[51] Int. Cl.[5] ..... B65H 5/02; B65H 5/22

[52] U.S. Cl. ..... 271/3.1; 271/6; 271/276

[58] Field of Search ..... 271/3.1, 6, 7, 264, 271/276, 291

[56] References Cited

U.S. PATENT DOCUMENTS

| | | | |
|---|---|---|---|
| 3,747,918 | 7/1973 | Margulis et al. . | |
| 3,863,912 | 2/1975 | Korff | 271/264 |
| 3,888,582 | 9/1982 | Griswold | 355/69 |
| 3,937,454 | 2/1976 | Colwill | 271/3.1 |
| 4,135,808 | 1/1979 | Morrison | 355/14 |
| 4,169,674 | 10/1979 | Russel . | |
| 4,231,562 | 11/1980 | Hori | 271/3.1 |
| 4,322,160 | 3/1982 | Kobux | 355/75 |
| 4,345,751 | 8/1982 | Holzhauser | 271/3.1 |
| 4,365,889 | 12/1982 | Silverberg | 271/3.1 |
| 4,412,738 | 11/1983 | Ahern et al. | 271/276 |
| 4,440,492 | 4/1984 | Howard | 271/6 |
| 4,589,651 | 5/1986 | Silverberg | 271/276 |
| 4,589,652 | 5/1986 | Silverberg | 271/276 |
| 4,618,138 | 10/1986 | Silverberg | 271/276 |
| 4,849,788 | 7/1989 | Prebola | 271/3.1 |
| 4,921,240 | 5/1990 | Watson | 271/276 |
| 5,027,162 | 6/1991 | Kida et al. | 271/291 |
| 5,037,079 | 8/1991 | Siegel et al. | 271/276 |

FOREIGN PATENT DOCUMENTS

| | | | |
|---|---|---|---|
| 48635 | 3/1982 | European Pat. Off. | 271/7 |
| 363807 | 4/1990 | European Pat. Off. | 271/6 |

*Primary Examiner*—Robert P. Olszewski
*Assistant Examiner*—Steven M. Reiss
*Attorney, Agent, or Firm*—Lawrence P. Kessler

[57] ABSTRACT

An improved recirculating document feeder for presenting sheets from a document sheet stack individually to a station of the reproduction apparatus for reproducing of information contained on such sheets. The improved recirculating document feeder comprises a housing containing a support for a document sheet stack. A feed path extends away from and then back to the document stack support, for directing sheets from the support into association with the reproducing station and then back to the stack. Document sheets are selectively fed from the stack seriatim about the feed path. The feed for the document sheets includes a transport assembly overlying at least a portion of the reproduction apparatus station. The transport assembly is mounted for movement relative to the housing, and engageable by a spacer associated with the reproduction apparatus station for self-adjustment of the transport assembly in the mount to locate the transport assembly a predetermined distance from the reproduction apparatus station irrespective of the position of the housing relative to said reproduction apparatus station.

5 Claims, 6 Drawing Sheets

RECIRCULATING DOCUMENT FEEDER HAVING A SELF-ADJUSTING BASE PLATE

CROSS-REFERENCE TO RELATED APPLICATIONS

This Application is related to U.S. patent applications Ser. No. 617,246, entitled IMPROVED RECIRCULATING DOCUMENT FEEDER, filed in the name of Russel et al; Ser. No. 617,337, entitled IMPROVED RECIRCULATING DOCUMENT FEEDER HAVING A CROSS-TRACK REGISTRATION MECHANISM, filed in the name of Rapkin et al; Ser. No. 617,249, entitled IMPROVED RECIRCULATING DOCUMENT FEEDER WITH STACK WEIGHT DETERMINED PRESSURIZED AIR/VACUUM LEVELS, filed in the name of Russel; Ser. No. 617,247, entitled IMPROVED RECIRCULATING DOCUMENT FEEDER WITH CONTROL OF DOCUMENT SHEET TRANSPORT, filed in the name of Russel et al; Ser. No. 617,336, entitled SEPARATION MEMBER FOR AN IMPROVED RECIRCULATING DOCUMENT FEEDER, filed in the name of Lawniczak; and Ser. No. 617,248, entitled MECHANISM FOR FACILITATING DOCUMENT SHEET SETTLING IN AN IMPROVED RECIRCULATING DOCUMENT FEEDER, filed in the name of Bergeron et al. All of these applications have been allowed.

BACKGROUND OF THE INVENTION

This invention relates in general to recirculating document feeders for use with electrostatographic reproduction apparatus, and more particularly to a recirculating document feeder having improved document sheet handling reliability due to a self-adjusting relation between the feeder and the reproduction apparatus.

In order to increase the productivity and ease of use of electrostatographic reproduction apparatus, it has been common practice to provide such apparatus with automatic document set handlers Early automatic document set handlers accepted a document set stack and removed individual document sheets from the stack one at a time (see U.S. Pat. No. 3,747,918, issued Jul. 24, 1973, in the name of Margulis et al). The removed document sheet was delivered to an exposure station of the reproduction apparatus where the desired number of reproductions of such document sheet were made. Thereafter, the document sheet was returned to the stack and the next document sheet was delivered to the exposure station. Such sequence of document sheet feeding and reproduction necessitated the use of an auxiliary sorter device in conjunction with the reproduction apparatus to provide collated reproduction sets corresponding to the document set. The use of a sorter device added to both the complexity and expense of the reproduction operation.

More recently, automatic document handlers typically referred to as recirculating document feeders have been developed. Recirculating document feeders, such as shown for example in U.S. Pat. No. 4,169,674 (issued Oct. 2, 1979, in the name of Russel) deliver document sheets seriatim to the reproduction apparatus exposure station and return the sheets to the document stack in order. At the exposure station, only one reproduction of each respective document sheet is made on one circulation. The desired number of reproductions is made by recirculating the document sheets from the stack to the exposure station and then back to the stack a corresponding number of times. By such reproduction sequence, the reproduction set of the document set is received at an output hopper in collated order. Thus no subsequent operational steps on the reproduction set are required.

While recirculating document feeders have proven very popular in that they enhance productivity and increase ease of use of the reproduction apparatus, they require complex construction to reliably recirculate the document sheets and effectively handle the document sheets in a manner to prevent damage thereto. Further, the relationship between the recirculating document feeder and the reproduction apparatus has to be accurately set up and constantly maintained to remain in adjustment. This is necessary to assure proper feeding operation of the document sheets through the interface between the recirculating document feeder and the reproduction apparatus. It is typically required that such set up and adjustment maintenance be accomplished by a trained service technician or a technically skilled operator. This adds considerably to the overall cost of maintaining the apparatus in proper working order.

SUMMARY OF THE INVENTION

This invention is directed to an improved recirculating document feeder for presenting sheets from a document sheet stack individually to a station of the reproduction apparatus for reproducing of information contained on such sheets, the recirculating document feeder having a self-adjusting relationship with the reproduction apparatus. The improved recirculating document feeder comprises a housing containing a support for a document sheet stack. A feed path extends away from and then back to the document stack support, for directing sheets from the support into association with the reproducing station and then back to the stack. Document sheets are selectively fed from the stack seriatim about the feed path. The feed for the document sheets includes a transport assembly overlying at least a portion of the reproduction apparatus station. The transport assembly is mounted for movement relative to the housing, and engageable by a spacer associated with the reproduction apparatus station for self-adjustment of the transport assembly in the mount to locate the transport assembly a predetermined distance from the reproduction apparatus station irrespective of the position of the housing relative to said reproduction apparatus station.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
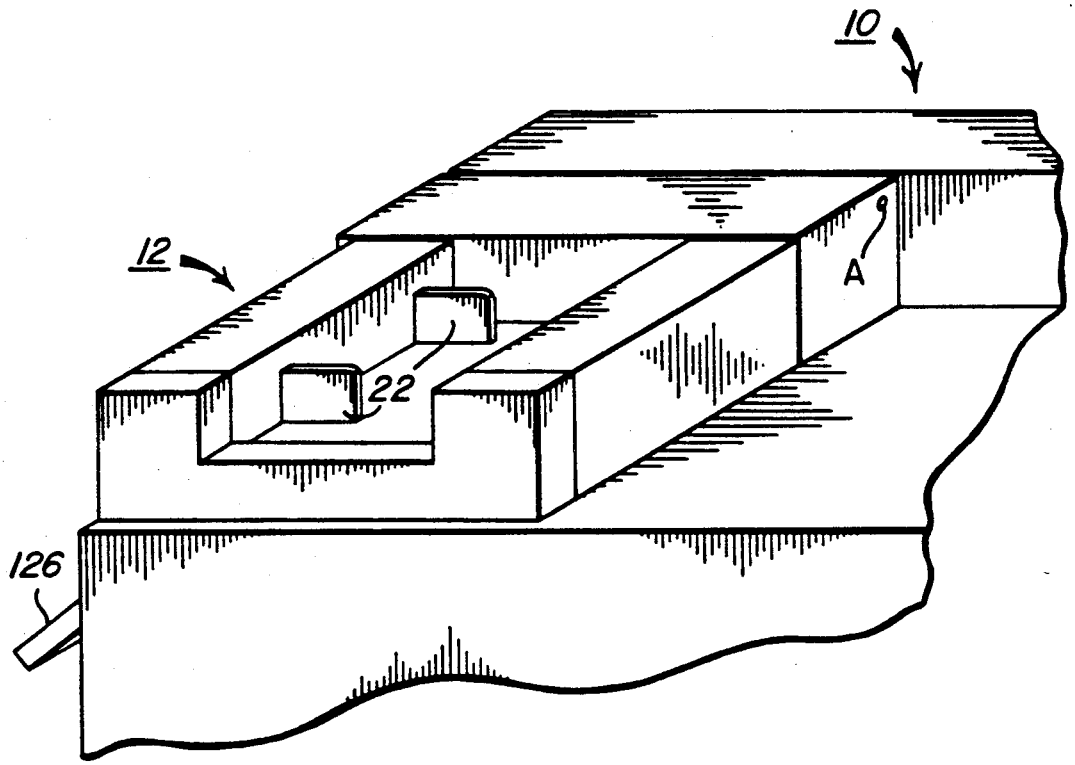
FIG. 1 is a general view, in perspective, of a typical reproduction apparatus with the improved recirculating document feeder according to this invention in operative association therewith.

Referring now to the accompanying drawings, FIG. 1 shows a typical reproduction apparatus 10 having the improved recirculating document feeder according to this invention, designated generally by the numeral 12, associated therewith. The reproduction apparatus 10 may be for example an electrostatographic copier, a thermal or electronic printer, or a photographic printer. The requirement common for any selected typical reproduction apparatus is that it includes a reproducing station where a document sheet is received, and information contained on the document sheet is extracted for reproduction by the apparatus. An example of such a reproducing station is a transparent platen where a document sheet placed thereon is exposed by a light source to obtain a reflected light image of the contained information. Of course, it is suitable for this invention to optically or electronically scan the document sheet in any well known manner to obtain the information for reproduction. Further, the reproduction apparatus 10 includes an electronically based control system, or the like, such as a microprocessor based controller, which communicates with the recirculating document feeder 12 to operate the feeder in coordinated synchronism with the reproduction apparatus.

Figure 2:
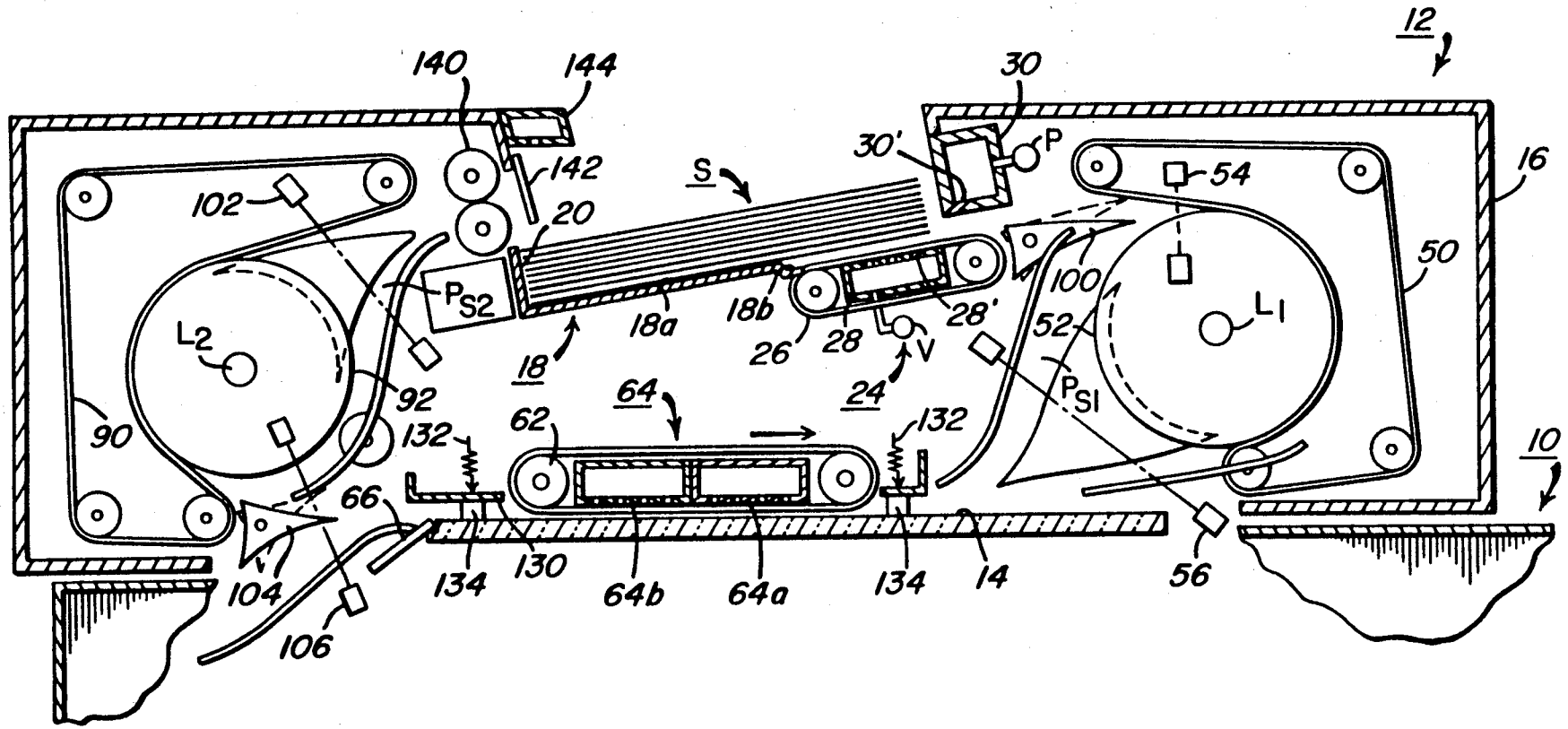
FIG. 2 is a front elevational view, in cross-section and on an enlarged scale, of the improved recirculating document feeder according to this invention.
Figure 3:
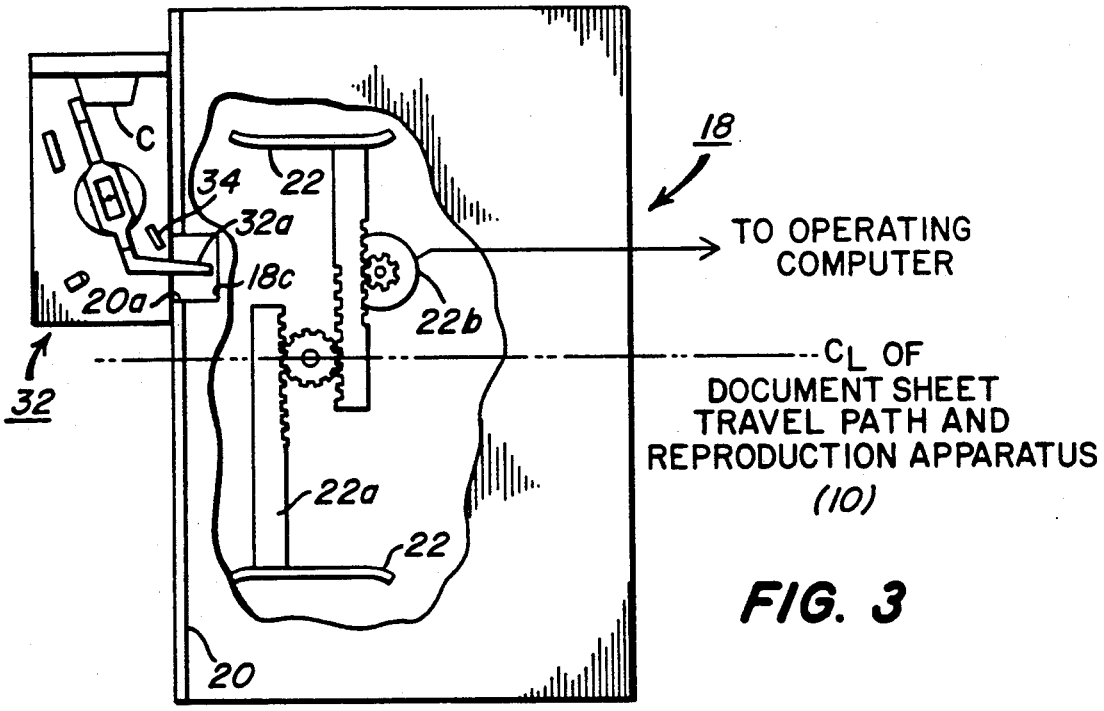
FIG. 3 is a top plan view of a portion of the improved recirculating document feeder, with portions removed to facilitate viewing, particularly showing the document sheet stack support tray, side guide adjustment mechanism, and set count finger assembly.

As best seen in FIGS. 2–8, the improved recirculating document feeder 12 includes a housing 16 attached to the reproduction apparatus 10 for pivotable movement about an axis A (see FIG. 1) to a position for locating the feeder in operative association with the reproducing station 14, or a position remote from the station to provide ready access thereto. A document sheet stack receiving hopper 18 having a tray formed by a stack supporting surface 18a is located within the housing 16. When the housing is operatively associated with the reproducing station 14, the hopper supporting surface 18a is positioned at an angle to the horizontal. Accordingly, a document sheet stack (designated generally by the letter S) placed in the hopper 18 on the surface 18a is urged by gravity such that the individual sheets in the stack are respectively aligned along one edge against a locating wall 20 disposed transversely relative to the document sheet travel path to be described hereinbelow. Side guides 22 (see FIGS. 3, 4) are adjustably positioned to engage marginal edges of the document sheet stack adjacent to the sheet edge engaging the wall 20 to properly locate the sheet stack in the direction transverse to the sheet travel path. Adjustment of the side guides is accomplished, for example, by a manually operated rack-and-pinion system 22a as shown in FIG. 3. A mechanism 22b, such as an adjustable potentiometer connected by a gear to the system 22a for example, provides a signal to the operating computer of the reproduction apparatus 10 to indicate the setting (document sheet size) of the side guides 22. The area immediately above the hopper 18 is unobstructed so that the operator can readily place a document sheet stack S in the hopper and always have a clear view of the document sheets in the stack in the hopper. The document sheet stack is loaded in the hopper 18 in its natural (page sequential) order with the first page of information facing upwardly.

Figure 4:
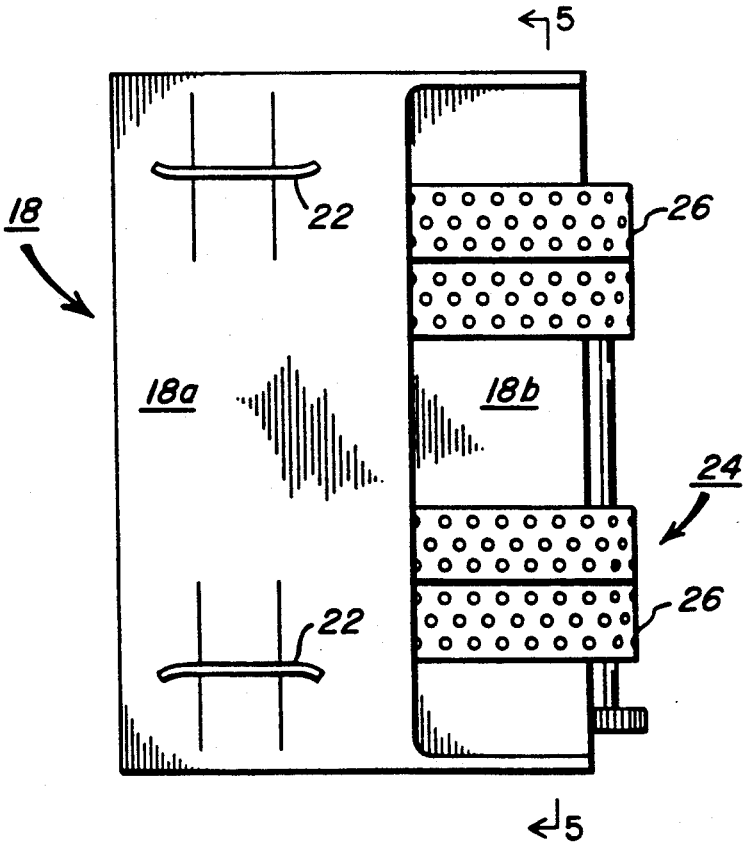
FIG. 4 is a top plan view of a portion of the improved recirculating document feeder similar to FIG. 3, with portions removed to facilitate viewing, particularly showing the document sheet stack support tray and feed belts.
Figure 5:
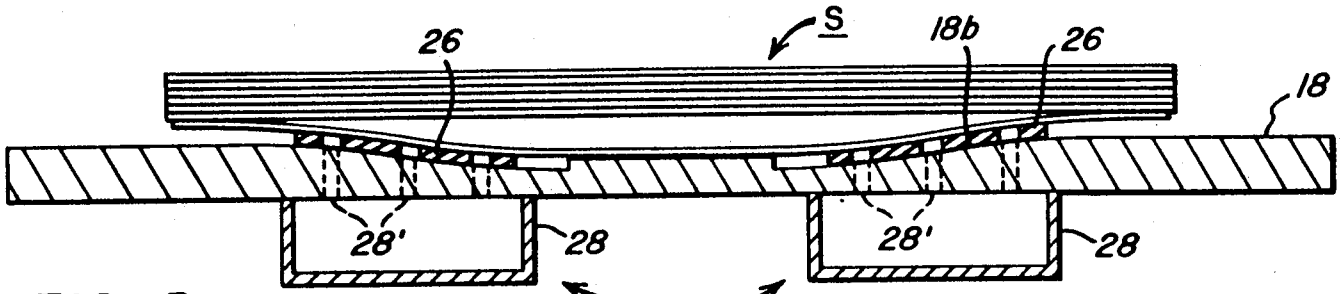
FIG. 5 is a side elevational view, in cross-section, of the portion of the recirculating document feeder shown in FIG. 4, taken along lines 5—5 of FIG. 4.

To facilitate feed (removal) of document sheets from the hopper 18 into the document sheet feed path, the stack supporting surface 18a of the hopper has a depressed portion 18b located adjacent to the side of the hopper opposite the wall 20. A document sheet removal device 24 is located in juxtaposition with the depressed portion 18b of the stack supporting surface 18a of the hopper 18. As best seen in FIGS. 4 and 5, the document sheet removal device 24 includes a plurality of belts 26. The belts 26, which are selectively driven about a closed loop path, are entrained around a vacuum plenum 28 connected to a vacuum blower V (see FIG. 2) and have a run at a level substantially coincident with the depressed portion 18b. The plenum 28 has a series of ports 28' in the upper surface thereof, such ports communicating with apertures 26' in the belts 26. Vacuum in the plenum draws the bottommost document sheet in the stack S on the supporting surface 18a into the depressed portion 18b to effect attachment of such sheet to the belts 26 (see FIG. 5). Movement of the belts 26 about their path will then cause such bottommost sheet to be removed from the stack.

The ease with which a document sheet can be removed from the bottom of a document sheet stack is dependent, at least in part, upon the sheet stiffness and weight, the overall weight of the document sheet stack, and the frictional force relationship between the bottommost sheet and the sheet immediately thereabove, the bottommost sheet and the supporting surface 18a of the hopper 18, and the bottommost sheet and the belts 26. In order to assure reliable document sheet removal, pressurized air is directed from an air pump P through an air jet assembly 30 toward the edge of the stack opposite the stack edge engaging wall 20 (i.e., the lead edge of the stack in the direction of sheet travel). The orientation of nozzles 30' of the air jet assembly 30 causes positive pressure air flow to be introduced between individual sheets of the document sheet stack S in the hopper 18. Such air flow levitates and separates the document sheets of the sheet stack. The force necessary to remove the bottom most sheet from the stack is thus reduced and misfeeds or multiple sheet feeds are substantially prevented.

The introduction of positive pressure air flow by the air jet assembly 30 reduces the frictional force between the bottommost sheet and the sheet immediately above it. However, such air flow also increases the frictional force between the bottommost sheet and the hopper supporting surface 18*a*. Accordingly, the coefficient of friction properties of the feed belts 26 in contact with the bottommost sheet, the coefficient of friction between bottommost sheet and the supporting surface 18*a*, and the areas and surface roughnesses of these interacting elements must be taken into account to establish a desired level of vacuum necessary for the feed belts to remove only the bottommost sheet from the hopper 18*a* for delivery into a downstream travel path.

Figure 9:
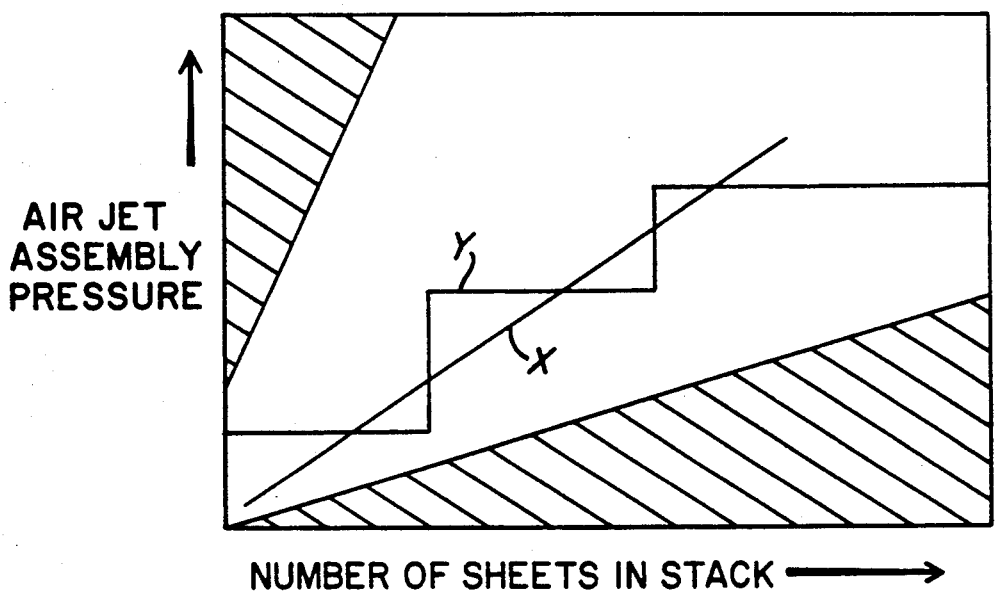
FIG. 9 is a graphical representation depicting the relationship between the number of document sheets in a document sheet stack and the pressure supplied to the air jet assembly.

The graphical representation of FIG. 9 shows the air jet assembly operating window for the recirculating document feeder 12 according to this invention, which extends from one document sheet to well over 100 sheets. Through the range of the number of document sheets in the document sheet stack in the recirculating document feeder (which determines the weight of the document sheet stack against the frictional surfaces thereof), it has been found necessary to either constantly vary the amount of vacuum and positive pressure air flow (line designated by the letter X in FIG. 9) or to vary those parameters in discrete steps (line designated by the letter Y in FIG. 9) such that the vacuum and pressurized air flow levels always define an operating point within the boundaries of the operating window. Operation at or near the boundary may result in lowered document sheet feeding reliability. This is due to the fact that too high an air flow may cause the document sheet stack to become disheveled, and insufficient air flow may enable the vacuum to effect multi-sheet feeds. When the air flow is kept within the defined operating window, the operation of the recirculating document feeder 12 has been reliable with document sheets in the range of thin papers (e.g., 13 lb. bond) up to and including heavy index and cover grades (e.g., 110 lb. index stock and 80 lb. cover stock).

Figure 6A:
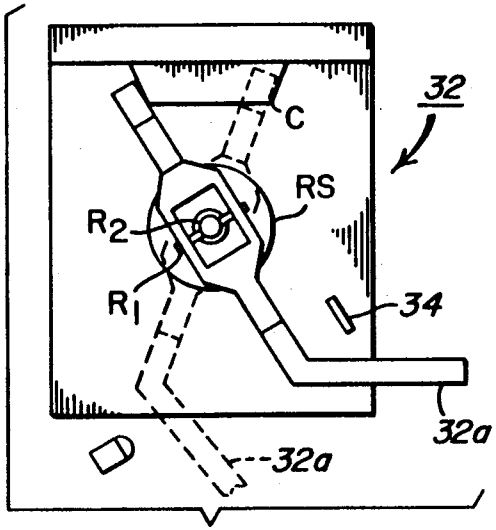
FIG. 6a is a top plan view of the set count separator assembly of FIG. 6 showing the remote position of the assembly finger in phantom.
Figure 6:
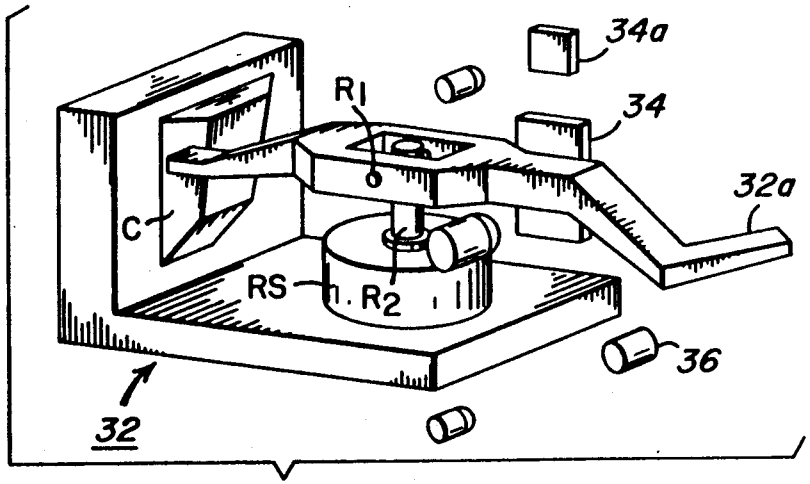
FIG. 6 is a view, in perspective, of the set count separator assembly of the recirculating document feeder according to this invention.

In order to establish the height of the document sheet stack, a set count assembly 32 (see FIGS. 3 and 6) is provided. The set count assembly 32 is located adjacent to wall 20 at the trailing edge of the document sheet stack S, and includes an elongated separator member in the form of a movable finger 32*a*. The finger 32*a*, extending through a slot 20*a* in the wall so as to overlie the trailing edge of the stack in the hopper 18, is supported on interconnected pivot rods $R_1$, $R_2$ for pivotal movement about the two mutually perpendicular longitudinal axes of such rods. The rod $R_1$ permits the finger 32*a* to pivot such that the finger can freely follow the level of the initial topmost document sheet in the stack S supported on the stack supporting surface 18*a* of the hopper 18. On the other hand, rod $R_2$ is coupled to a rotary solenoid RS which upon actuation of the solenoid pivots the finger 32*a* to and from a remote position (phantom line position of FIG. 6*a*). The end portion of the finger 32*a*, opposite to the end portion engaging the initial topmost document sheet in the stack S, engages a cam member C. The cam member C has a profile which, upon pivot movement of the finger 32*a* about the longitudinal axis of rod $R_2$ by the rotary solenoid RS after the initial topmost sheet is fed from the hopper 18, causes the finger to move to its remote position, to be raised to a level above the maximum stack height accommodated in the hopper, and returned to its initial position (solid line position of FIG. 6*a*) to once again engage the initial topmost sheet returned to the stack S.

In operation, at the beginning of a reproduction cycle, the set count finger 32*a* is located so as to contact the initial topmost sheet of the document sheet stack. A sensor 34 detects the position (height above the stack supporting surface 18*a*) of the set count finger 32*a* resting on the top of the document sheet stack S, and thus enables the thickness of the stack (which is also a simple measure of the number of sheets in the stack) to be determined. The sensor 34 provides a signal which communicates with the operating computer of the reproduction apparatus 10 to enable the computer to set the speed of the vacuum blower V and/or adjust various valves (not shown) to proportion the pressurized air and vacuum levels to levels that have been predetermined to provide satisfactory operation for the detected number of document sheets in the stack. Alternatively, several switches may be used to accomplish measurement of the document sheet stack height, detecting for example that the stack contains less than 10, between 10 and 50, or more than 50 sheets.

The set count assembly 32 also includes a sensor 36 which detects when the last document sheet of the stack S (the one which initially was topmost at the start of the reproduction cycle) has been fed from the hopper 18. An opening 18*c* defined in the sheet supporting surface 18*a* of the hopper is located to enable the set count finger 32*a* to drop through the supporting surface to a position below the supporting surface when the last document sheet has been fed. At such position, the sensor 36 "sees" the set count finger and provides a signal which communicates with the reproduction apparatus computer to indicate that a reproduction of the entire document sheet stack has been completed. The computer can then precisely determine the number of document sheets in the stack, since it has been counting the number of sheets fed as the reproduction cycle has progressed. At the completion of reproduction of the first document sheet stack set, the computer can readjust the pressurized air and vacuum levels to levels corresponding to the optimum operating levels for the particular number of document sheets in that document sheet stack.

Further, a sensor 38 (see FIG. 3) is mounted in association with the side guides 22 to detect the location thereof. The sensor 38 provides a signal which communicates with the reproduction apparatus computer to indicate the setting for which the side guides 22 have been adjusted (i.e., for the size of the document sheets that the side guides have been adjusted to accommodate). Input of the size of the document sheets enables the computer to calculate or otherwise determine the total weight of the document sheets in the hopper 18. Based upon the determined total weight of the document sheet stack, the computer can then provide for an additional adjustment of the pressurized air and vacuum levels to produce optimum performance and maximum reliability of the recirculating document feeder 12.

If the pressurized air flow is too high, it can cause excess fluffing of the document sheet stack. Excess fluffing of the sheet stack creates a condition where, at the completion of reproduction of a document sheet stack set, the set count finger 32*a* can be improperly returned to other than the top of the sheet stack. To avoid such condition, the reproduction apparatus computer is programmed to pause after the end of a reproduction cycle for the document sheet stack set (as determined by sensor 36 detecting the set count finger 32*a*), and turn off the air pressure momentarily. This enables the stack to settle in the hopper 18 and the set count finger 32*a* to return reliably to rest on the top sheet of the settled stack. Then the computer, knowing exactly the number of document sheets, can readjust the pressurized air and vacuum level settings.

Since heavy weight document sheets are ordinarily thicker than light weight document sheets, determining the number of sheets in the document sheet stack is not a perfect measure of the stack weight. However, by comparing the document sheet stack height as determined by the stack height sensors with the actual count of the number of document sheets, the reproduction apparatus computer can calculate the thickness of each sheet. Suppose, for example, that there is only one stack height sensor (e.g., sensor 34) set to detect if there are more than ten sheets of 20 lb. bond paper in the hopper 18. When the reproduction cycle starts, the set count finger 32*a* is placed on top of the stack. If the sensor detects that there are more than ten sheets of paper, the computer does not know how many more sheets are in the stack, nor does it know what the thickness (and thus the weight) of each sheet is, nor can it calculate the total weight of the stack.

In this example, if the computer counts 25 sheets when it senses the end of reproduction of the first document sheet stack set, it still does not know the thickness of each sheet. The best the computer can do is adjust the pressurized air and vacuum levels to levels corresponding to the center of the operating window for 25 sheets with a weight equivalent to 20 lb. bond paper (most commonly used and nearest to average sheet weight). If, however, the sheets are actually 110 lb. index stock instead, they will weigh about twice as much as 25 sheets of 20 lb. bond paper. For optimum operation on 110 index stock, the pressurized air and vacuum level settings should be relatively increased to provide better levitation of the stack above the bottommost sheet and an increased driving force between the drive belts and the bottommost sheet to better pull the bottommost sheet out from underneath the weight of the stack above it. If, however, the stack height sensor 34 initially detects that there are fewer than ten sheets of 20 lb. bond paper, the computer can set the pressurized air and vacuum levels accordingly, but it still does not know exactly how many sheets there are in the stack, nor their weight.

In order to provide for more accurate control of the pressurized air and vacuum level settings, the following method may be employed. Suppose, for example, that on start of the reproduction cycle, the sensor 34 detects that more than the equivalent of ten sheets of 20 lb bond paper are contained in the stack in the hopper 18. The reproduction apparatus computer, on receipt of the appropriate signal from the sensor 34, sets the initial pressurized air and vacuum levels. As the reproduction cycle continues, at some point the set count finger 32*a* will pass through the point at which it senses ten sheets of 20 lb. bond paper. From that point on, the computer tallies a second count of the number of sheets to the completion of reproduction of the document sheet stack set. If the computer counts approximately ten sheets, then it knows that the sheets are probably 20 lb. bond paper; if it counts approximately five sheets, then it can deduce that the sheets are a heavier grade, like 110 lb. index stock; and if it counts approximately twenty sheets, then it can deduce that the sheets are probably 13 lb. bond paper. Now the computer has enough information to determine the weight of the entire stack since it also knows the total number of sheets in the document stack and can multiply the total number of sheets by the deduced weight of each sheet. This additional information is sufficient to alter the pressurized air and vacuum level settings to approximate optimum level settings for the determined stack height and weight The setting of pressurized air and vacuum levels is most critical for sheet stacks of heavy weight papers. The described additional intelligence that the computer gains from deducing the individual sheet weight allows the earliest possible optimization of operating parameters for the recirculating document feeder 12 to be attained. On the other hand, for stacks with fewer than ten sheets, precise setting of the vacuum level is not as important. That is, with smaller stacks, excess gripping force between the feed belts 26 and the bottommost sheet is not a disadvantage unless the paper is porous enough so that the next bottommost sheet in the sheet stack is also attracted to the belts (which can result in a multiple sheet feed). Setting of the air pressure level for the air jet assembly 30, however, is more critical with only a few sheets since excess air pressure may cause the sheets to be lifted entirely out of the hopper 18. Accordingly, to improve the ability to optimally provide for pressurized air and vacuum level settings, it is desirable to provide at least two levels of pressurized air and vacuum level settings and two stack height sensors (e.g., 34 and 34*a*) for determining the initial start-up operating parameters. For document sheet stacks containing less than the minimum number of sheets detectable by the stack height sensor (i.e., ten sheets in the above example), the computer still does not know whether the weight of the sheets is light, medium, or heavy. But, since the operating window is sufficiently wide, it has been found that reliability for recirculating sheets of smaller stacks is not appreciably degraded.

The second stack height sensor 34*a* enables a finer determination of the height of the document sheet stack to be made; e.g., less than five sheets, between five and ten sheets, and more than ten document sheets. With such a sensor arrangement, the reproduction apparatus computer can tally the number of sheets required for actuating the different stack height sensors as the set count finger 32*a* passes through the range from the start of the reproduction cycle to the end of the cycle. If the computer starts out knowing, for example, that there are more than ten sheets, it can wait until the ten-sheet sensor is actuated, then tally the number of feed cycles necessary to detect the actuation of the five-sheet sensor. If the number of document sheet feeds is approximately five, then the document sheets are probably 20 lb. bond paper. If the tally is only two or three, then the sheets are probably 110 lb. index stock, and the pressurized air and vacuum level settings can be adjusted without having to wait until the end of a reproduction cycle for the document sheet stack set. The earlier the setting determination is made, the sooner the operating parameters can be optimized so as to enhance the reliability of document sheet separation and feeding.

The concept of utilizing multiple stack height detection sensors can be carried to its ultimate extent by employing an analog stack height sensor rather than the discrete (digital) sensors (34, 34*a*) described above.

Figure 10:
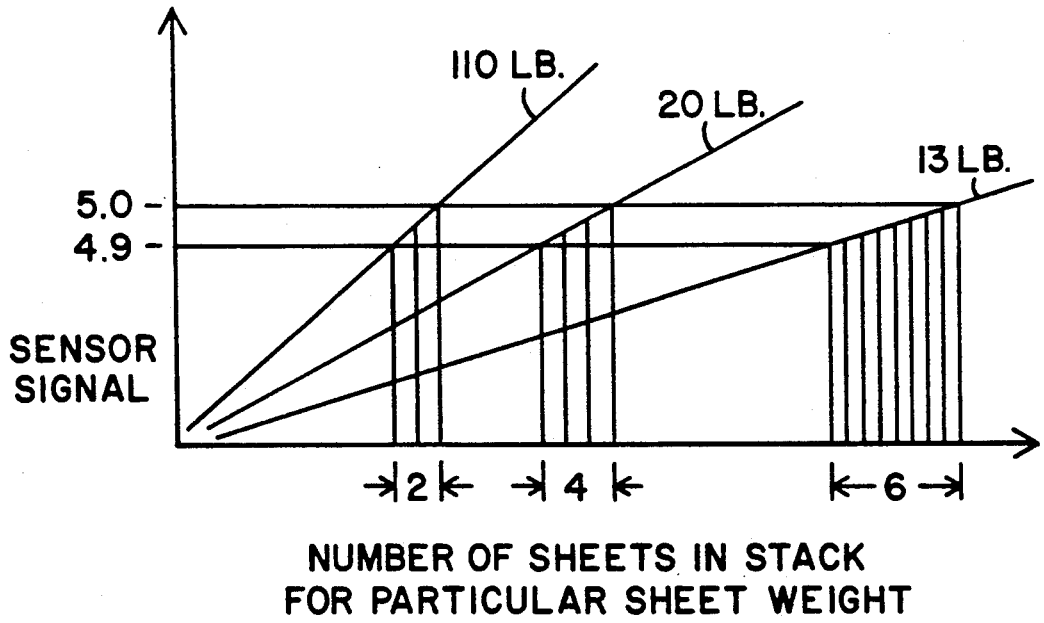
FIG. 10 is a graphical representation depicting the relationship between the number of document sheets in a document sheet stack (for a particular sheet weight) and sensor signal.

When the set count finger of the set count assembly comes to rest on the top of the document stack, the analog sensor provides an analog voltage signal (directly corresponding to stack height) to the reproduction apparatus computer. Accordingly, for each position of the set count finger, the computer can calculate the number of document sheets in the stack. The graph of FIG. 10 shows a straight-line correspondence between the document sheet stack (set count finger) height and number of document sheets for various weights of paper (i.e., line E corresponds to 110 lb. index stock, line F corresponds to 20 lb. bond paper, and line G corresponds to 13 lb. bond paper). As the reproduction cycle begins, the pressurized air and vacuum level settings are set at a default (compromise) condition since the computer does not know whether the document sheets in the stack are heavy or light in weight. As the reproduction cycle continues, however, the computer can count the number of feed cycles and compare the actual count of document sheets fed with the calculated number of document sheets based on the instantaneous height of the set count finger. From this comparison, the computer can match the slope of the actual straight line correspondence between the set count finger height and the number of sheets with one of the theoretical paper weight lines (lines E, F, or G) to determine the individual sheet weight. According to such determination, the computer can accurately predict the number of sheets in the document sheet stack and the weight of the stack within only a few sheets, and readjust the pressurized air and vacuum level to optimum settings.

Another way of looking at the concept of utilizing the analog stack height sensor 34' to determine stack weight can also be seen in FIG. 10. By the two horizontal lines drawn through 5 volts and 4.9 volts in the graph, it can be seen that six sheets of 13 lb. bond paper (line G), four sheets of 20 lb. bond paper (line F), or two sheets of 110 lb. index stock (line E) each cause the analog stack height sensor to transmit the same amount of voltage change to the computer. Regardless of the number of sheets, if the computer calculates that the analog sensor voltage is changing at the rate of so many sheets per volt, multiplying the value of sheets per volt times the initial analog sensor voltage determines the number of initial sheets, or the total number of sheets in the stack and thus allows the calculation of the total weight of the stack. This can be done within just a few feed cycles at the beginning of reproduction of the document sheet stack, then updated at mid-stack or at the end of the reproduction cycle for the stack.

Referring again to FIG. 2, as a document sheet is fed from the hopper 18, it passes beyond air jet assembly 30 where its lead edge is captured by the transport belt 50 entrained in part about wheel 52 (the transport belt and wheel arrangement may include multiple belts and corresponding wheels positioned in spaced relation along the longitudinal axis $L_1$ of wheel 52). The belt 50/wheel 52 arrangement defines a sheet travel path between the hopper 18 and the platen 14 of the reproduction station of apparatus 10. As the lead edge of the sheet is captured, it passes across a lead edge fed sensor 54. This tells the reproduction apparatus computer that the sheet has been successfully fed and that the vacuum applied to the plenum 28 (and thus feed belts 26) can be turned off. The drive for the feed belts 26 continues so that the belts do not present a frictional drag on the sheet; and the drive for the feed belts 26 is turned off after the trailing edge of the document sheet has passed the area of such belts. At that time, vacuum is re-established in the plenum 28 so as to cause the next document sheet (now the new bottommost document sheet of the stack) to adhere to the belts 26 to ready such sheet for feeding in the proper timed sequence. However, such sheet is not yet drawn into the stream of the sheet travel path because the belts 26 are stationary.

Meanwhile, the first document sheet is fed by transport belt 50 and continues its travel around wheel 52. In the case of simplex copying, since only the front side of the respective document sheets are to be copied, the document sheet is directed onto the platen 14 past platen entrance sensor 56. The document sheet is driven by transport belt 50 until the lead edge is adjacent apertured platen drive belts 60. The platen drive belts 60 are entrained about rollers 62, and are selectively driven in a closed loop path in the direction of the associated arrow with the lower run of the belts in juxtaposition with the platen 14. A multi-chamber vacuum plenum 64 is located within the closed loop path and has a ported lower surface so as to operatively communicate with the lower run of the apertured platen drive belts 60. Accordingly, with vacuum applied to both chambers **64*a* and 64*b* of the plenum 64, the belts 60 effectively grasp the document sheet and transport it across the platen 14. At an intermediate point in the travel of the document sheet across the platen, the speed of the platen drive belts 60 is slowed so that as the sheet is brought into contact with a lead edge registration gate 66, the sheet does not strike the gate with such force as to damage its leading edge. Additionally, vacuum to the first camber 64*a* of the multi-chamber plenum 64 is turned off, leaving only the vacuum applied to the second chamber 64*b* and the portion of the belts 60 nearest the lead edge of the sheet at registration gate 66**.

Figure 7:
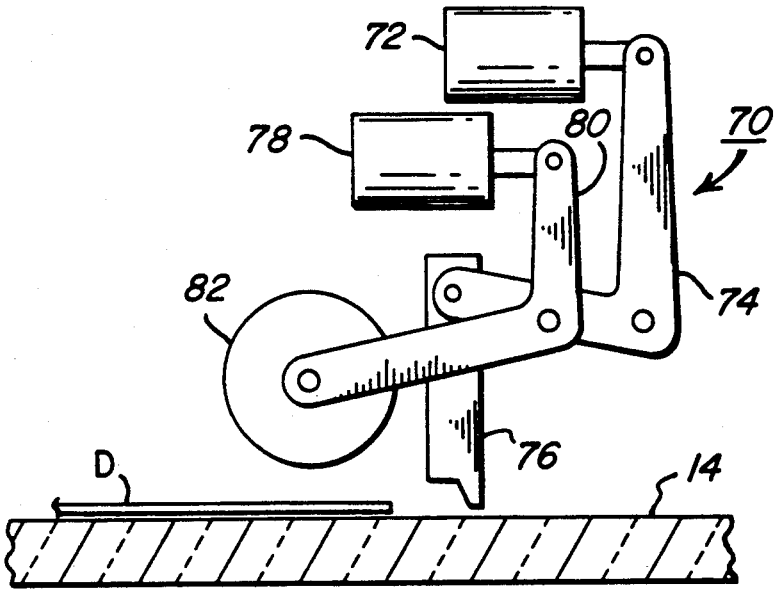
FIG. 7 is a side elevational view of a portion of the improved recirculating document feeder, with portions removed to facilitate viewing, particularly showing the cross-track adjustment and registration mechanism.

After the lead edge of the document sheet has been registered against the gate 66, the document sheet is registered in a cross-track direction (transverse to the sheet travel path) by a cross-track registration mechanism 70. As best shown in FIG. 7, the mechanism 70 includes a first solenoid 72 which when actuated rotates a pivotable crank arm 74 to cause a foot 76 to lower against the platen 14. This establishes a registration edge for the front marginal edge of the document sheet (the edge nearest the operator). The registration edge defines a position for the document sheet where the image of information contained on the document sheet can be properly and consistently reproduced on an aligned receiver sheet in the reproduction apparatus 10. A second solenoid 78 of the cross-track registration mechanism 70 is actuated after the foot 76 engages the platen 14. The second solenoid 78 rotates a pivotable rocker arm 80 to bring a rotating wheel 82 down onto the document sheet. The rotating wheel 82 moves the document sheet laterally across the platen 14 (transverse to the direction of travel of the document sheet about the closed loop path from the hopper 18 to the platen 14 and back to the hopper) until the front marginal edge of sheet is registered against the foot 76. The solenoid 78 thereafter effects raising of the rotating wheel 82 so as to not disturb the registered sheet.

After the document sheet has been properly registered at the gate 66 and against the foot 76, the reproduction apparatus 10 exposes the sheet in any well known manner to obtain an image of the information contained on the sheet. Subsequent to exposure of the document sheet, the lead edge registration gate 66 is lowered to a remote position out of the document sheet travel path, and platen drive belts 60 are allowed to transport the sheet off the platen 14. The document sheet is then directed into engagement with transport belt 90 and wheel 92 which capture the sheet and carry the sheet around the wheel 92 (in a manner similar to the transport effected by the transport belt 50 and wheel 52) defining a travel path between the platen 14 and the hopper 18. The normal document sheet travel path from hopper 18 via belt 50/wheel 52 to platen 14 assures that the top (information bearing) face of the document sheet will be placed face down on the platen 14. Thereafter, return of the document sheet from its face down orientation on the platen 14 via belt 90/wheel 92 to the hopper 18 will always return the document with a face up orientation in the hopper.

The return of document sheets to the hopper 18, for proper restacking on the stack S supported on the surface 18*a*, is assisted by a driven nip roller assembly 140. The nip roller assembly, located downstream of the belt 90/wheel 92 (in the direction of document sheet travel), maintains control of respective document sheets until they are well into the area over the stack S. Further, at least one flexible strip of material 142 (commonly referred to as a dangler) intercepts the travel path of the returning document sheets exiting from the nip roller assembly 140. The strip 142 urges the returning document sheets downwardly toward the stack. However, it takes some time for a document sheet to settle on the stack in the hopper 18. With the rapid operational characteristics for the recirculating document feeder 12 according to this invention, it is necessary to assure rapid settling to prevent misfunction of the feeder operation, such as for example the return of the set count assembly finger 32*a* prior to settling of the initial topmost document sheet on the stack. Accordingly, an air jet assembly 144 is provided. The air jet assembly directs pressurized air from above the document sheet travel path toward the stack S downstream (in the direction of document sheet travel) of the flexible strip 142. The positive air pressure acts on the returning document sheets to cause the respective sheets to be expeditiously restacked with the least amount of resettling time The recirculating document feeder 12 according to this invention is constructed in a particularly described manner to selectively turn document sheets over whereby information contained on both sides thereof can be imaged in proper sequence by the reproduction apparatus 10. Accordingly, the apparatus 10 can accomplish duplex copying or simplex copying from duplex document sheet stacks, while maintaining the document sheets in face up order in the hopper of the recirculating document feeder 12 to enable an operator to always be able to see such face.

With a document sheet stack of duplex documents (i.e., documents which contain information on both the front and back sides thereof), in order for the finished reproduction sets to be in proper sequential order, alternating reproduction cycles image the back side of each document sheet in the stack and then the front side of each document sheet. The respective cycles for imaging of the front sides of the document sheets is carried out in the manner described above. On the respective alternate cycles, when it is desired to image the back sides of the document sheets, a document sheet is fed from the hopper 18 by the document sheet removal device 24 described above, and progresses across the top of diverter 100 to be captured by belt 50 and wheel 52. As the trailing edge of the document sheet passes the sheet fed sensor 54, belt 50 and wheel 52 are stopped by a clutch/brake assembly (not shown). Diverter 100 is then rotated slightly counter clockwise to its phantom line position in FIG. 2, into intercepting relation with the document sheet travel path, and belt 50 and wheels 52 are driven to rotate in a reverse direction. Accordingly, the captured document sheet is transported in a reverse direction and directed by the diverter 100 into a secondary travel path $P_{S1}$. When in the secondary travel path $P_{S1}$, the document sheet is detected by the platen entrance sensor 56 as it is transported onto platen 14. The signal from the sensor 56 to the reproduction apparatus computer causes the sequence of platen transport events described above to be carried out in the manner described above. The transport of the document sheet through the secondary travel path $P_{S1}$ effects an inversion of the document sheet so that the back side thereof is face down on the platen 14 for imaging of the information contained thereon. Meanwhile, as the trail edge of the document sheet passes the platen entrance sensor 56, diverter 100 is returned to its normal (solid line) position, the direction of drive for the belt 50 and wheel 52 are reversed (to their initial drive direction), and the drive belts 26 are readied to accept another document sheet feed command.

After the back side of the document sheet has been imaged, registration gate 66 is lowered, platen drive belts 60 are actuated to drive the document sheet off the platen 14, and the document sheet is transported to the belt 90 and wheel 92 for capture thereby. However, if such document sheet were allowed to proceed in the travel path described above, the sheet would end up in hopper 18 with its front side (originally upwardly oriented face) oriented downwardly. This condition would cause confusion for the operator and would place the document sheets in an improper page sequential order. In order to overcome these problems and return the document sheet to the hopper 18 in its original first side face up orientation, return sensor 102 detects the lead edge of the document sheet and provides an appropriate signal for the reproduction apparatus computer. Such signal causes the diverter 104 to be rotated slightly counter-clockwise to its phantom line position in FIG. 2, into intercepting relation with the document sheet travel path, and the direction of drive for belt 90 and wheel 92 to be reversed through a clutch/brake (not shown). The document sheet is thus directed to proceed through a secondary travel path $P_{S2}$. As the trailing edge of the document sheet passes the platen exit sensor 106, the sensor detects the sheet and provides an appropriate control signal for the computer. In response to such control signal, the diverter 104 is returned to its normal (solid line) position where it is ready for directing travel of the next document sheet. Meanwhile, the document sheet proceeds along the secondary travel path $P_{S2}$ back into hopper 18, and completion of the feed cycle for such sheet is determined by the return sensor 102 which detects the trailing edge of the sheet. This process is repeated for each document sheet in the stack, and for the number of times equal to the operator selected desired number of reproductions of the document stack.

An important aspect of the recirculating document feeder 12 according to this invention is the use of an adaptive timing control of the various transport elements of the feeder as opposed to a strict fixed time sequencing of events. This has been found to be necessary since experience has shown that the physical characteristics of the document sheets varies not only from brand to brand, but from sheet to sheet, even within the same ream. It is natural, therefore, to expect that the passing of a sheet over mechanical devices that induce drag, frictional forces and other influences can present different timing effects on each sheet even if all document sheets of a stack are created from paper from within the same ream. Moreover, the individual document sheets of a stack may not all be the same kind, brand, weight or texture. With the high transport speeds necessary in modern reproduction apparatus including a device such as the recirculating document feeder 12, individual events occur during extremely short time intervals, for example on the order of a few milliseconds each. A fixed timing controller which follows a definitive program to turn on and off clutches, pressurized air and vacuum valves, solenoids, etc., can hardly be expected to present an optimum set of operating conditions for each individual sheet in a stack.

In order to control the sequence of events and to maximize the reliability of the recirculating document feeder 12 and its individual elements, a more individualistic operational approach is utilized. The sensors that control the timing of individual events are best shown in FIG. 2. Sensor 54 detects that a document sheet has actually been fed from the hopper 18 sufficiently for the transport belt 50/wheel 52 to capture and control the transport of the sheet. Platen entrance sensor 56 detects that the document sheet has properly negotiated the turn about the wheel 52 and is progressing toward the platen 14. As the lead edge of the document sheet is detected by the platen entrance sensor 56, the reproduction apparatus computer effects establishment of the vacuum levels in the multi-chamber plenum 64 and sets the appropriate speed of the transport belts 60. As the trail edge of the document sheet is detected by the platen entrance sensor 56, the drive for the transport belts 60 is adjusted to start slowing down the belts to a second appropriate speed so as to prevent lead edge damage as the document sheet is registered at the gate 66. Platen exit sensor 106 detects that the document sheet has actually left the platen 14 and effects an increase in the velocity of the belts 60 to transport the sheet off the platen as quickly as possible. As the trail edge of the document sheet is detected by the platen exit sensor 106, a control signal to the computer indicates that the document sheet has been captured by the transport belt 90/wheel 92 sufficiently to be the sole transporting mechanism for the document sheet, and that the gate 66 can be returned to its travel path intercepting position in readiness for registration of the next document sheet. Return sensor 102 detects that the document sheet is returning to the hopper area as the lead edge of the sheet is detected, and that the sheet has completely left the transport belt 90/wheel 92 as the trailing edge of the sheet is detected by such sensor.

In the mode of operation for handling duplex document sheets, all of the described events become more important when the action of the reversal clutch/brakes and travel path diverters are brought into play. Upon the detection of the trail edge of a document sheet by the fed sensor 54, such sensor provides a signal for the computer to indicate that the document sheet is clear of the diverter 100 and that it is safe to move such diverter to its phantom line position. When the document sheet travel is then reversed by actuation of a clutch/brake to reverse direction of the transport belt 50/wheel 52, the document sheet can enter properly into the secondary travel path $P_{S1}$. As the trail edge of the document sheet is detected by the platen entrance sensor 56, the diverter 100 can be allowed to return to its solid line position in preparation for directing the next document sheet. Likewise, as the trail edge of the document sheet is detected by the platen exit sensor 106, an appropriate signal to the computer indicates that it is safe to move the diverter 104 to its phantom line position so that the document sheet, on reversed travel, can enter into the respective secondary return travel path $P_{S2}$.

The times of the document sheet transport events is monitored as each document sheet progresses around the travel path from hopper 18 to platen 14 and back to the hopper. Comparing the nominal estimated times for these events with the actual times enables the computer to decide, based on experience criteria, to allow the document sheet transportation cycle (and thus the reproduction cycle) to continue, or to stop the sheet transport entirely in order to prevent a jam condition from causing damage to the document sheet. Additionally, the individual sheet timing measurements can be used to alter the velocity of travel path transport belts, rollers and drives so as to correct the document sheet travel velocities in various portions of the travel path and bring them back to a nominal condition. This sort of adaptive timing will enable the recirculating document feeder 12 to accommodate for things like excessive friction buildup in drive shafts, bearings and the like, or for loss of sheet velocity because of slippage on frictional surfaces. Within reason, adjustments can be made in the velocities of drive shafts, as long as there is a limit to the amount of adjustment correction imposed. That is, a certain amount of speed correction is employed in conjunction with statistical data collection and analysis that points to diverse occurrences such as potential bearing seizures, friction surface changes and the like, which are communicated to service personnel to indicate that certain mechanical or electrical components are in need of replacement or other attention.

Figure 8:
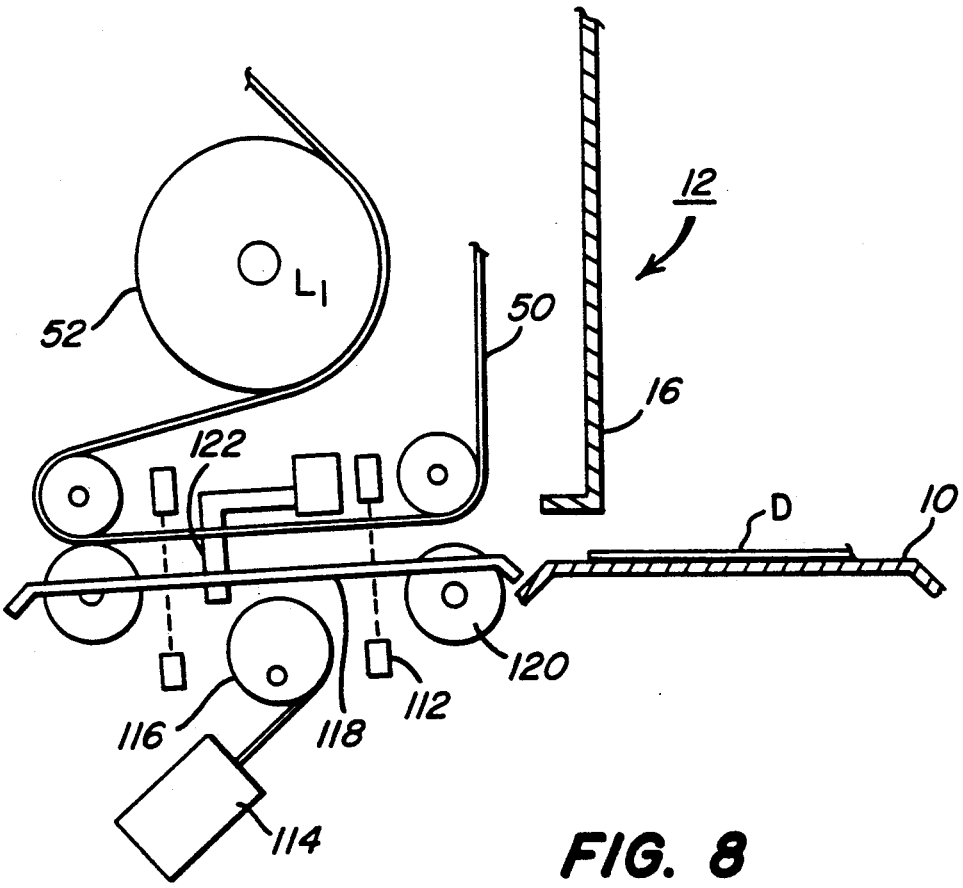
FIG. 8 is front elevational view of a portion of the improved recirculating document feeder, with portions removed to facilitate viewing, particularly showing the individual document sheet positioner therefor.

As another aspect of the recirculating document feeder 12 according to this invention, such feeder is constructed to enable an operator to introduce a single sheet onto the platen without having to place it in the hopper 18. As shown in FIG. 8, a document sheet D is placed on a work surface 110 of the reproduction apparatus 10 adjacent to the feeder 12. The document sheet is manually urged into the feeder 12 until the sheet intercepts a document present sensor 122. This action signals the feeder to complete its present reproduction cycle, reverse the direction of transport belt 50/wheel 52, and to actuate solenoid 114 which pulls cam lever 116 so as to raise plate 118. Raising the plate 118 brings roller 120 into engagement with belt 50 to capture the document sheet D between roller and the belt, and transport the sheet forward (toward the left in FIG. 8) until it strikes gate 122. Since the document sheet is being constantly urged against the gate 122 by the belt 50, any skew in the document sheet is corrected by alignment of the sheet with the gate.

At an appropriate time, solenoid 124 is actuated to raise gate 122, allowing the properly aligned document sheet to proceed onto the platen 14. The document sheet is transported across the platen 14 by belts 60 up to gate 66 where sheet alignment is corrected a second time if necessary. After the reproduction apparatus 10 has captured an image of information contained on the document sheet, gate 66 is lowered, diverter 104 is moved to its phantom line position, and the document sheet is transported off the platen 14 into a collection hopper 126 (shown in FIG. 1). Successive document sheets can be introduced into the recirculating document feeder 12 in a like manner.

The recirculating document feeder 12 according to this invention can also be used in a manual mode. For manual mode use, the operator lifts the feeder about its pivot connection with the reproduction apparatus 10 and places a document on the platen 14. The feeder is then returned to its closed position if the document has no substantial thickness (i.e., a sheet of paper), or remains in the partially raised position in the instance where the document is a book or solid object while the reproduction apparatus makes a reproduction. Moreover in the manual mode for the recirculating document feeder 12, the reproduction apparatus 10 can be used to make reproductions of continuous computer forms (fanfold sheets). A tractor drive mechanism (not shown) is attached to the reproduction apparatus to pull the continuous computer forms across the platen 14 under the recirculating document feeder in its closed position without having to thread the forms through any part of the feeder. Further, the recirculating document feeder can be raised or closed without disturbing the continuous computer forms path.

Another aspect of the recirculating document feeder according to this invention is to provide a constant gap between the base plate 130 and the platen 14. Since document sheets must pass through this gap in their travel across the platen, this spacing is a critical parameter. That is, if the gap is too large, the document sheet may not properly register at the gate 66 and foot 76 and may be held out of the depth of focus for the imaging system of the reproduction apparatus 10; on the other hand, if the gap is too small, the document sheet may jam between the base plate and the platen. The base plate 130, supported in the housing 16 of the recirculating document feeder 12, carries the platen transport belts 60 (and associated multi-chamber vacuum plenum 64) and the cross-track registration assembly 70. The support for the base plate 130 includes springs 132 urging the base plate in a direction toward the platen 14 when the recirculating document feeder 12 is in operative relation with the reproduction apparatus 10. Accordingly, the base plate 130 will "float" relative to the remainder of the recirculating document feeder when the feeder is lifted off the platen, but will come to rest against fixed spacer pads 134 when the feeder is in operative association with the reproduction apparatus. The spacer pads 134 accurately determine the spacing between the base plate and the surface of the platen. With this described spacer pad arrangement, there are no adjustments necessary to guarantee the spacing between the base plate and the platen during operative association of the recirculating document feeder with the reproduction apparatus. In addition, since the vacuum to the belts 60 is effective in this constant predetermined gap, air flow characteristics passing through this space are guaranteed to be more stable and determinant from one recirculating document feeder to another since the flow is effective in a fixed space rather than a variable space that would result from differing adjustments.

The invention has been described in detail with particular reference to preferred embodiments thereof, but it will be understood that variations and modifications can be effected within the spirit and scope of the invention.

We claim:

1. An improved recirculating document feeder for presenting sheets from a document sheet stack individually to a station of a reproduction apparatus for reproducing information contained on such sheets, said improved recirculating document feeder comprising:

a housing;

means mounted in said housing for supporting a document sheet stack;

means, defining a feed path in said housing extending away from and then back to said document stack supporting means, for directing sheets from a document sheet stack on said document stack supporting means into association with said reproduction apparatus station and then back to such stack; and means for selectively feeding respective sheets from the stack seriatim about said feed path, said feeding means including a transport assembly including a base plate adapted to define a document sheet transport gap with said reproduction apparatus station, a ported belt supported by said base plate in a closed loop configuration with one run of said belt being substantially coextensive with at least a portion of said base plate, means for moving said ported belt in a path about said closed loop, and a vacuum chamber in flow communication with said ported belt to selectively tack a document sheet to said belt for movement therewith, means for mounting said transport assembly for movement relative to said housing, and spacing means associated with said reproduction apparatus station and engageable with said transport assembly for self-adjustment of said transport assembly in said mounting means to locate said transport assembly a predetermined distance from said reproduction apparatus station when in contact with said spacing means to establish said document sheet transport gap.

2. The invention of claim 1 wherein said mounting means includes a plurality of independent urging means for respectively urging said base plate toward said reproduction apparatus station.

3. The invention of claim 2 wherein said urging means are springs.

4. The invention of claim 3 wherein said spacing means includes a plurality of stops respectively having base plate engaging surfaces located a predetermined distance from said reproduction apparatus station, whereby when said base plate is urged into engagement with said stops by said springs, said base plate self-adjusts to its predetermined location relative to said reproduction apparatus station.

5. The invention of claim 4 wherein said plurality of stops and plurality of springs are respectively disposed such that self-adjustment of said base plate occurs in both the front-to-back and side-to-side directions.

* * * * *